US010494072B2

(12) United States Patent
Gai et al.

(10) Patent No.: US 10,494,072 B2
(45) Date of Patent: Dec. 3, 2019

(54) DOUBLE EFFECT HYDRAULIC ACTUATING CYLINDER

(71) Applicant: Ultraflex S.p.A., Casella (GE) (IT)

(72) Inventors: Marcella Gai, Casella (IT); Enrico Pagani, Casella (IT)

( * ) Notice: Subject to any disclaimer, the term of this patent is extended or adjusted under 35 U.S.C. 154(b) by 0 days.

(21) Appl. No.: 15/907,635

(22) Filed: Feb. 28, 2018

(65) Prior Publication Data

US 2018/0257751 A1 Sep. 13, 2018

(30) Foreign Application Priority Data

Mar. 10, 2017 (IT) ..... 102017000026657

(51) Int. Cl.

| | |
|---|---|
| ***B63H 5/125*** | (2006.01) |
| ***B63H 20/08*** | (2006.01) |
| ***B63H 20/12*** | (2006.01) |
| ***F15B 15/14*** | (2006.01) |
| ***B63H 25/42*** | (2006.01) |
| *B63H 25/12* | (2006.01) |

(52) U.S. Cl.

CPC ..... *B63H 20/12* (2013.01); *B63H 25/42* (2013.01); *F15B 15/1457* (2013.01); *B63H 25/12* (2013.01)

(58) Field of Classification Search

CPC .... B63H 20/08; B63H 20/12; B63H 2020/08; B63H 25/42; B63H 25/12; F15B 15/1457

USPC ..... 440/53, 61 S, 61 C

See application file for complete search history.

(56) References Cited

U.S. PATENT DOCUMENTS

| | | | | |
|---|---|---|---|---|
| 4,098,167 A * | 7/1978 | Dijksterhuis | ..... | F16B 13/0891 411/75 |
| 5,471,909 A * | 12/1995 | Kobelt | ..... | F15B 15/1433 92/161 |
| 5,542,864 A | 8/1996 | Peebles | | |
| 2005/0164572 A1 | 7/2005 | Sasayama | | |
| 2010/0095839 A1 | 4/2010 | Rhoades | | |

(Continued)

FOREIGN PATENT DOCUMENTS

| | | | | |
|---|---|---|---|---|
| CN | 205674060 U * | 11/2016 | ..... | B25B 11/00 |
| JP | 07208431 A * | 8/1995 | ..... | F16B 35/00 |

(Continued)

*Primary Examiner* — Daniel V Venne

(74) *Attorney, Agent, or Firm* — Themis Law

(57) ABSTRACT

Double-acting hydraulic actuating cylinder, particularly for hydraulic steering devices of outboard marine engines. The cylinder is slidably mounted on at least one rod coaxial to the cylinder sealingly protruding from at least one head of the actuating cylinder and carrying a separating piston that divides the cylinder into two variable volume chambers, each one of such two chambers has an inlet/outlet for the hydraulic fluid, each connected to one of two inlets/outlets of the pump and a sealing head for the relative sliding between the cylinder and the rod, which sealing head is integral with the cylinder itself. The rod is provided to be connected to a fastening bracket to fasten the cylinder to the engine, in a not slidable manner and in such a way as to allow the relative rotation of the engine with respect to the transom along an axis parallel to the axis of the rod. The rod has at least one flattened surface to be grasped by a tool having at least one corresponding flat engagement surface for engaging said flattened surface.

11 Claims, 6 Drawing Sheets

(56) References Cited

U.S. PATENT DOCUMENTS

2014/0138080 A1* 5/2014 Yorga ..... E21B 19/14
166/77.51

FOREIGN PATENT DOCUMENTS

| | | |
|---|---|---|
| JP | H08276896 | 10/1996 |
| WO | 0112502 | 2/2001 |

* cited by examiner

DOUBLE EFFECT HYDRAULIC ACTUATING CYLINDER

FIELD OF THE INVENTION

The object of the present invention is a double effect, or double-acting, hydraulic actuating cylinder, particularly for hydraulic steering devices of outboard marine engines.

BACKGROUND OF THE INVENTION

Outboard engines generally comprise an end for the fastening to the transom of a watercraft on which the engine is mounted so as to rotate around a substantially vertical steering axis.

The steering device comprises a closed hydraulic circuit with at least one pump actuated by steering means, such as a steering wheel, a rudder or the like, while the cylinder is slidably mounted on at least one rod coaxial thereto and sealingly protruding from at least one head of the actuating cylinder and carries a separating piston that divides the cylinder into two variable-volume chambers.

Each of the two chambers has at least one inlet/outlet for the hydraulic fluid, each connected to one of two inlet/outlet of the pump, and a sealing head for the relative sliding between cylinder and rod, the sealing head being integral with the cylinder itself.

Furthermore the rod is connected to a fastening bracket to fasten the cylinder to the engine, in a not slidable manner and in such a way as to allow the relative rotation of the engine with respect to the transom along an axis parallel to the axis of the rod.

Finally, there is a tiller arm fastened to the engine and integral with the cylinder, for steering the engine.

The above described configuration is the common configuration of the double-acting hydraulic actuators currently known and widely used.

This invention actually concerns hydraulic cylinders, regardless of their specific design, whether they are cylinders as described above, unbalanced cylinders or any other cylinder known in the state of the art.

Typical examples of such actuators are described in document EP 1488996 of the Applicant.

The various components of the known actuator cylinders are therefore widely used and tested in order to optimize the operation of the cylinders.

Although these devices perform their function satisfactorily, they have some drawbacks.

One of the most common drawbacks is the difficulty of disassembling the rod from the bracket fastening the cylinder to the engine. In fact, this fastening is usually carried out by nuts cooperating with threaded appendages obtained at the ends of the rod. The bracket has L-shaped end elements provided with corresponding through holes in which the threaded ends are inserted to be tightened by the nut.

The rod and cylinder are free to move relative to each other, so that the aforementioned fastening means are the only rotational constraint of the rod. Therefore, when disassembling the cylinder, a clamp tool must be used to allow the rod to be clamped when the bracket fastening nuts are unscrewed. On the other hand, the grip of this tool can damage the surface of the rod, resulting in a loss of seal between the cylinder and the rod.

SUMMARY OF THE INVENTION

Purpose of this invention is to implement a simple and inexpensive measure which allows the problem to be at least partially solved.

The purpose of the invention is achieved by a cylinder as described above, where the rod has at least one flattened surface to be grasped by a tool having at least one corresponding flat engagement surface to engage said flattened surface.

Preferably, the flattened surface is obtained in proximity of at least one, preferably both, the opposite ends of the rod. In this way, an ad hoc area for grasping the rod is created in at least one region not involved in the cylinder sliding, thereby facilitating the disassembly of the bracket without the risk of damaging the rod.

Since there are clamp elements with one of the two jaws having circular section, the purpose can be achieved by a single flattened surface, even though the maximum advantage is achieved when, at one or both ends of the rod, there are two diametrically opposed flattened surfaces to be grasped by means of a wrench or clamp tool having corresponding facing flat surfaces for the engagement with said flattened surfaces.

The ends of the rod may have a male thread, i.e. a threaded surface on the outer side of the rod, usually in an end zone having smaller section, for the coupling with a nut or a female thread, i.e. an axial threaded hole for the coupling with a bolt.

According to an embodiment, the flattened surface is obtained on the outer thread in proximity of the end of the rod. Advantageously, the length of the thread and the position of the flattened surface are such that, when the bracket is mounted on the rod with the nut tightened, the thread portion containing the flattened surface is not, at least partially, engaged by the nut.

This solution is functional, although not optimal. In fact, the flattened surface is obtained in an already weakened rod region, which is thus further weakened.

For this reason, the preferred solution provides that the flattened surface is obtained at a certain distance from the end of the rod, regardless of the type of thread used.

In an embodiment, the distance of the flattened surface from the end of the rod is such that, when the bracket is mounted on the rod, the flattened surface is positioned within the thickness of the end element of the bracket. This can be achieved, for example, by using an annular shoulder abutting the end of the rod. In this way, better protection against salt is provided in both the threaded region and the region weakened by the flattened surface, and greater strokes of the cylinder on the rod are allowed.

The protection can be increased even more by obtaining, on the rod in a backward position with respect to the flattened surface, an annular groove for the insertion of a sealing ring. Advantageously, the flattened surface has such a longitudinal extent to be at least partially enclosed in the thickness of the end element of the bracket in order to ensure the seal.

Further characteristics and improvements are object of the dependent claims.

BRIEF DESCRIPTION OF THE DRAWINGS

The characteristics of the invention and the advantages descending therefrom will become more apparent from the following detailed description of the accompanying drawings, in which.

DETAILED DESCRIPTION OF EMBODIMENTS OF THE INVENTION

The figures in the present patent application show a preferred embodiment of the cylinder object of the present invention, but these figures should be considered for illustrative purposes only, to better understand concepts and advantages of the present invention.

In fact, these figures should not to be considered restrictive for the concept claimed in the Patent Application, the concept consisting of making an actuating cylinder with easily removable and replaceable fastening brackets.

Figure 1:
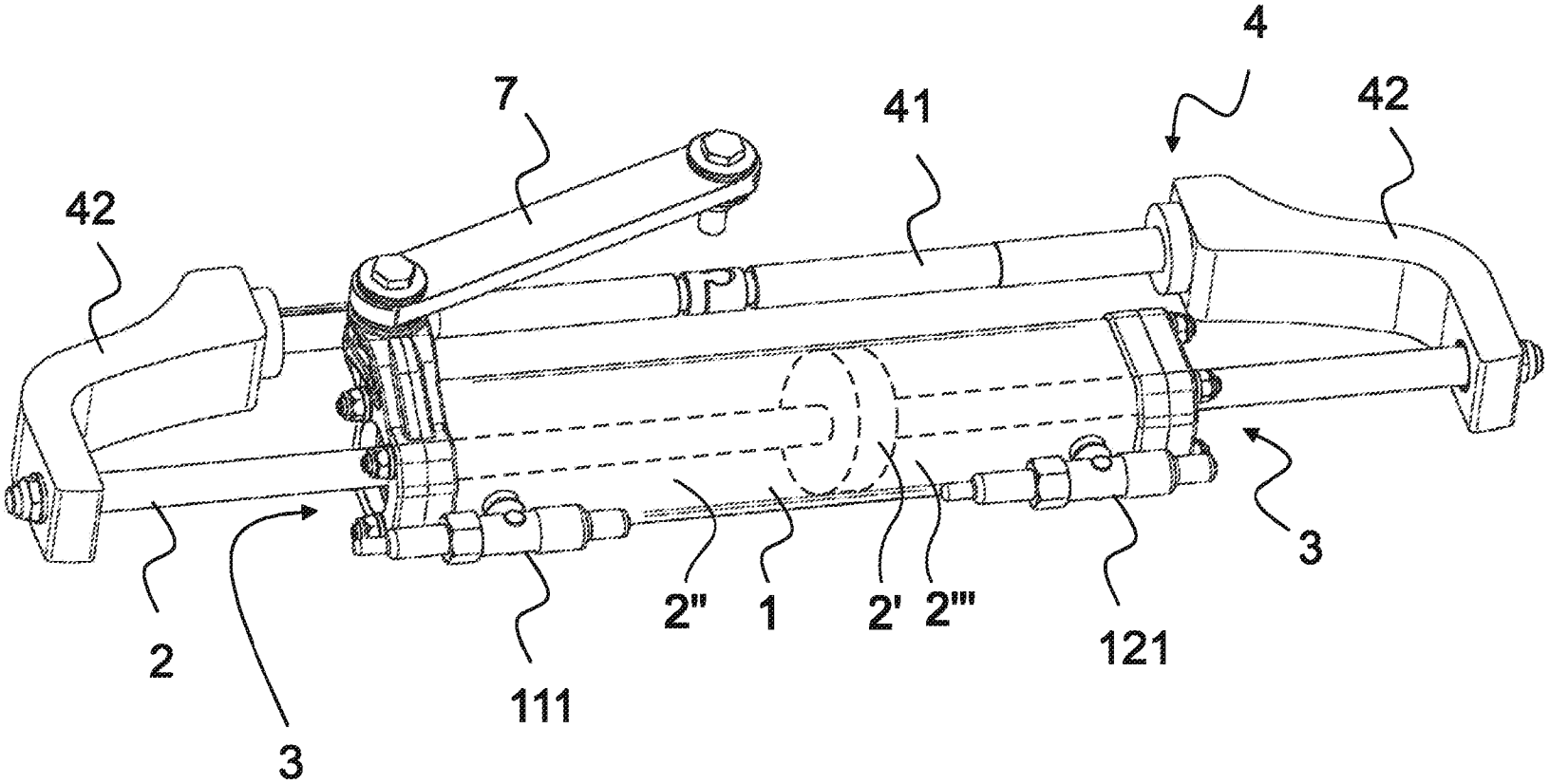
FIG. 1 shows a perspective view of an actuating cylinder according to the known art.
Figure 2:
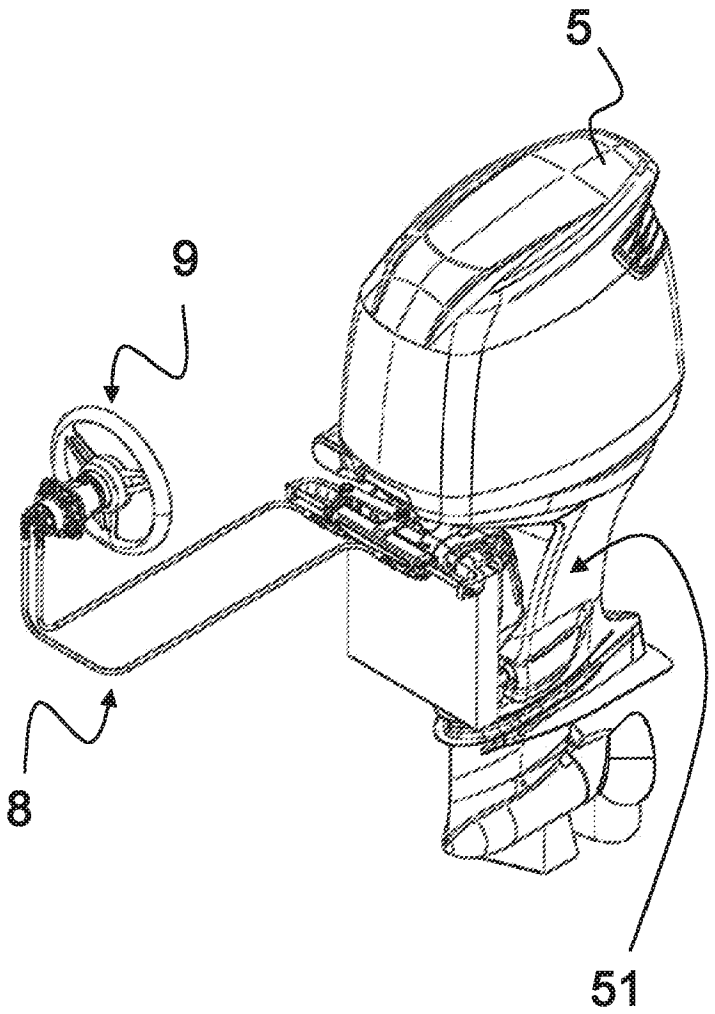
FIG. 2 shows the installation of the cylinder shown in the preceding figure in a steering device for marine engines.

Referring in particular to FIGS. 1 and 2, a hydraulic driving system for outboard marine engines is described hereinafter.

The system comprises a closed hydraulic circuit 8 with at least one pump 9 operated by steering means, such as a steering wheel, a rudder or the like.

The cylinder 1 is slidingly mounted on at least one rod 2 coaxial to the cylinder 1, which sealingly protrudes from at least one head of the actuating cylinder 1 and carries a separating piston 2' that divides the cylinder into two variable-volume chambers 2" and 2'".

Each of the two chambers has an inlet/outlet 111, 121 for the hydraulic fluid, each connected to one of two inlets/outlets of the pump 9, and a sealing head 3 for the relative sliding between the cylinder 1 and the rod 2, the sealing head 3 being integral with the cylinder itself.

The rod 2 is connected to a fastening bracket 4 to fasten the cylinder 1 to the engine 5, in a not slidable manner and in such a way as to allow the relative rotation of the engine 5 with respect to the transom along an axis parallel to the axis of the rod 2.

The translation of cylinder 1 along the rod 2 allows the engine 5 to rotate thanks to the arm 7, which transmits the movement of the cylinder 1 to the engine 5.

The fastening bracket 4 consists of a rod 41 positioned with its longitudinal axis parallel to the longitudinal axis of rod 2 and connected thereto through two L-shaped end elements 42 shaped as arms and defined "bull horn" in jargon due to their shape that calls to mind the horns of a bull.

Figure 3:
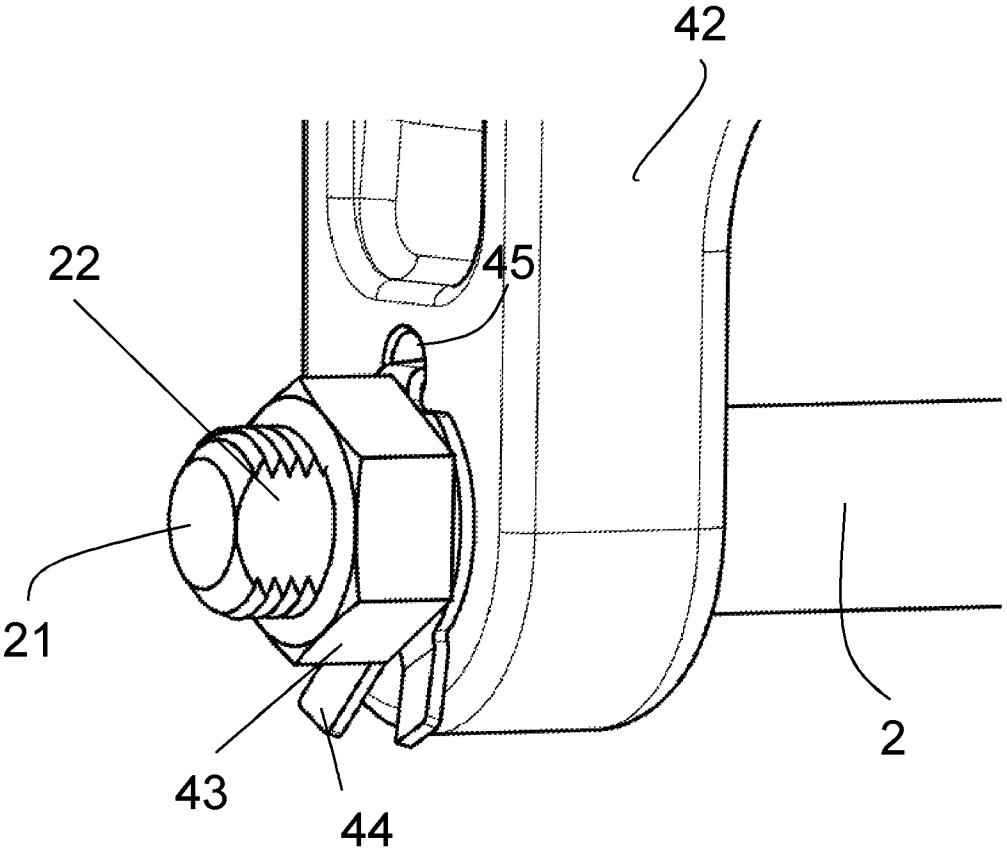
FIG. 3 shows a detail of the cylinder according to an embodiment of the present invention with the rod coupled to the bull-horn arm of the fastening bracket.

FIG. 3 shows the rod 2 coupled to the arm 42 in a first cylinder configuration according to the invention.

The rod 2 has an end with reduced section 21 that is inserted into a through hole provided on the arm 42, which is correspondingly perforated. The end 21 is threaded and has flattened surfaces 22, i.e. diametrically opposed flat surfaces obtained, for example, by milling. The nut 43 tightens the threaded end with the interposition of a washer 44 thus fastening the rod 2 to the arm 42 in a similar way to what happens in the known devices.

The washer 44 has radial legs 44' (FIG. 7) foldable on the head of the nut 43 and inside a hole 45 obtained in the arm 42 to prevent the nut from being accidentally unscrewed and guarantee a given tightness level.

The flattened surfaces 22 are obtained on the thread close to the head 21 of the rod 2 and typically have a longitudinal extent less than the length of the threaded end. According to an improvement, advantageously the length of the thread and the position of the flattened surfaces 22 are such that, when the arm 42 is mounted on the rod 2 with the nut 43 tightened, the thread portion containing the flattened surfaces 22 is not, at least partially, engaged by the nut 43. In this way a tool, such as for example a wrench or clamp, can be used to loosen the nut 43 without the rod 2 starting to rotate. Once the nut is loosened, the tool is no longer required, so the extra stroke of the rod due to the end flattened surfaces can be limited to what is strictly necessary in order to ensure that the rod is grasped when applying the starting torque to unscrew the nut.

This solution with flattened surfaces on the threaded head is typically adopted on both ends 21 of the rod 2, even if there may be asymmetrical configurations with flattened surfaces arranged only on one end of the rod. In fact, when the nut has been completely removed, the flattened surfaces can be accessed again and can be used to loosen the nut arranged on the opposite end.

Figure 4:
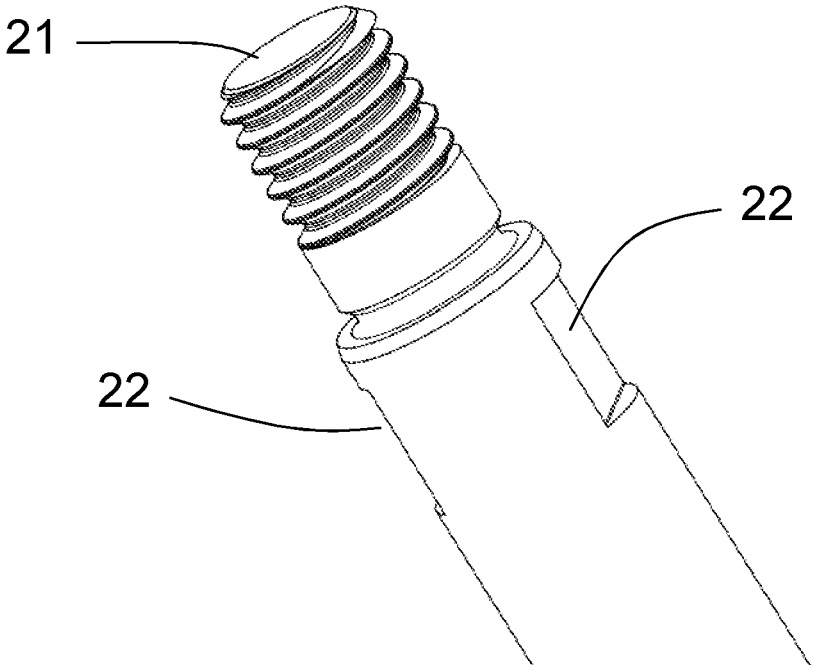
FIG. 4 shows the end portion of the rod in a second embodiment of the invention.
Figure 5:
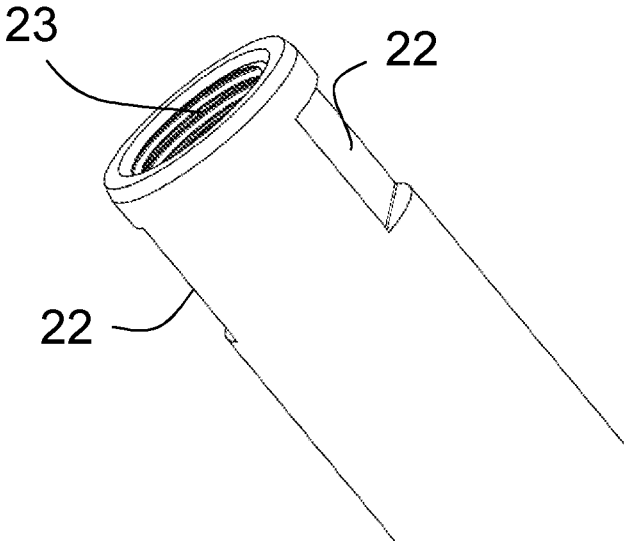
FIG. 5 shows the end portion of the rod in a third embodiment of the invention.

FIGS. 4 and 5 show solutions with flattened surfaces obtained at different positions. As in the case described above, the rod 2 shown in FIG. 4 has an end 21 with reduced threaded section to be inserted into a through-hole provided on the bull horn. However, the flattened surfaces 22 are not on the thread, but on the end portion of the rod in backwards position with respect to the thread.

In this way the rod does not contribute to further weakening the reduced section part, thereby guaranteeing greater strength of the structure. In addition, no increase in the overall dimensions on the nut side has to be provided in order to allow the coupling with the wrench or clamp.

Figure 6:
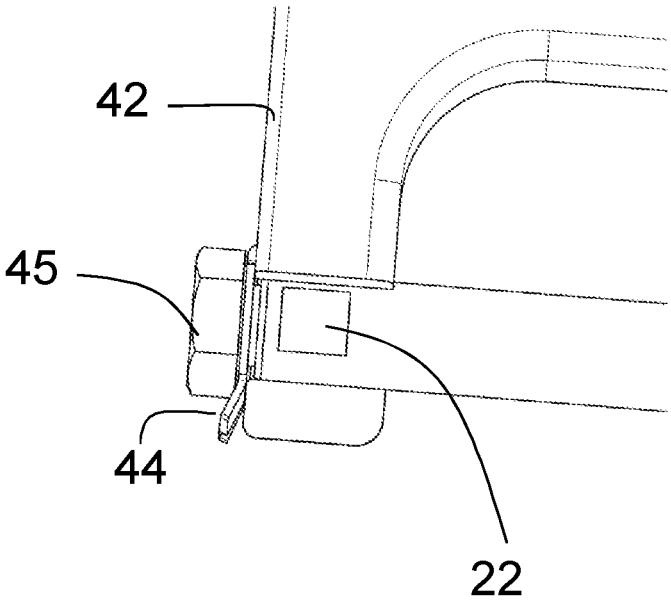
FIG. 6 shows, in section, the flattened surface of rod positioned in the thickness of the bull horn.

FIG. 5 shows a similar configuration with flattened surfaces 22 on the end of the rod. In this case, the rod has truncated end with a threaded axial hole 23 for the coupling with a bolt 45 shown in detail in FIGS. 6 and 7.

In both configurations shown in FIGS. 4 and 5, the flattened surfaces 22 can be provided at a distance from the head of the rod 2 such that, in assembled condition, they are placed near the bull horn on the side facing the cylinder. In this way, grasping by the tool is always possible, thereby making disassembly very easy.

This, however, has the disadvantage that in order to ensure that the head gasket of the cylinder can overlap the flattened area, the rod travel being unchanged, longer rods are required thus resulting in loss of seal.

Figure 7:
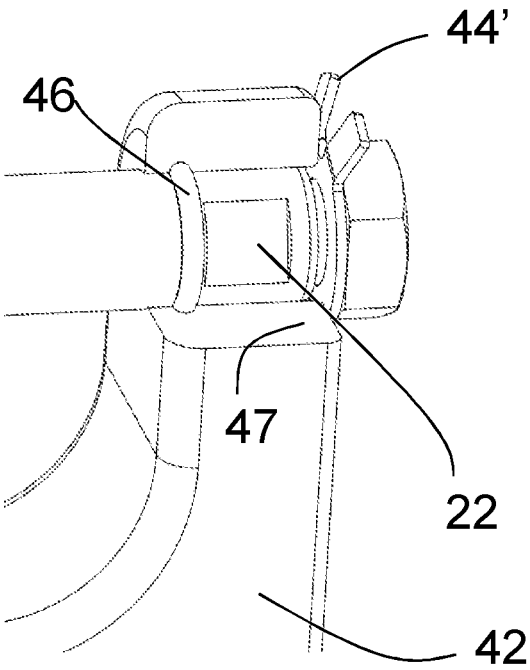
FIG. 7 shows an additional embodiment with an annular groove on the rod and a sealing ring.

To avoid this, a further embodiment provides that the flattened surfaces 22 are made at a distance from the end of the rod 2 such as to fall, in an assembled condition, inside the bull horn 42 by using, for example, an annular shoulder or an abutment washer 47 abutting against the end of the rod 2. This not only ensures maximum travel to cylinder 1 on rod 2, but also increases the saline protection. By providing the use of an O-ring 46 positioned in an annular groove arranged in a recessed position with respect to the flattened surfaces 22, as shown in FIG. 7 for the bolt configuration, it is in fact possible to make the cavity of the bull horn 42 water-resistant at least as regards splashes with considerable benefits in terms of wear of the parts, thanks to the use of above-described washer 44, which provides some protection on the opposite side of the bull horn as well.

This embodiment with flattened surfaces arranged inside the thickness of the bull horn 42, both with and without sealing O-ring 46 or retaining ring 44, is particularly clever. In fact, as evident, if the flattened surfaces are hidden inside the bull horn, any grasping tool is completely unusable. However the inventors observed that, actually, when the rod of a cylinder should be disassembled from the bull horns provided at the ends, that is to say when a torque is applied to one or both nuts/bolts, the rod does not tend to rotate due to friction forces. Only after at least one of the nuts/bolts has been loosened, the rod begins to rotate, thus preventing the other nut/bolts from unscrewing. Hence the idea of hiding the flattened surface for grasping the rod. After one of the two nuts/bolts has been loosened, in fact, the rod can be pulled out of the corresponding bull horn thus freeing the flattened surfaces that can then be used to unscrew the other nut/bolt.

In order to achieve the maximum protection against splashes of water, another aspect of the invention involves working on the cylinder head, in particular on the fastening mechanism thereof.

Figure 8:
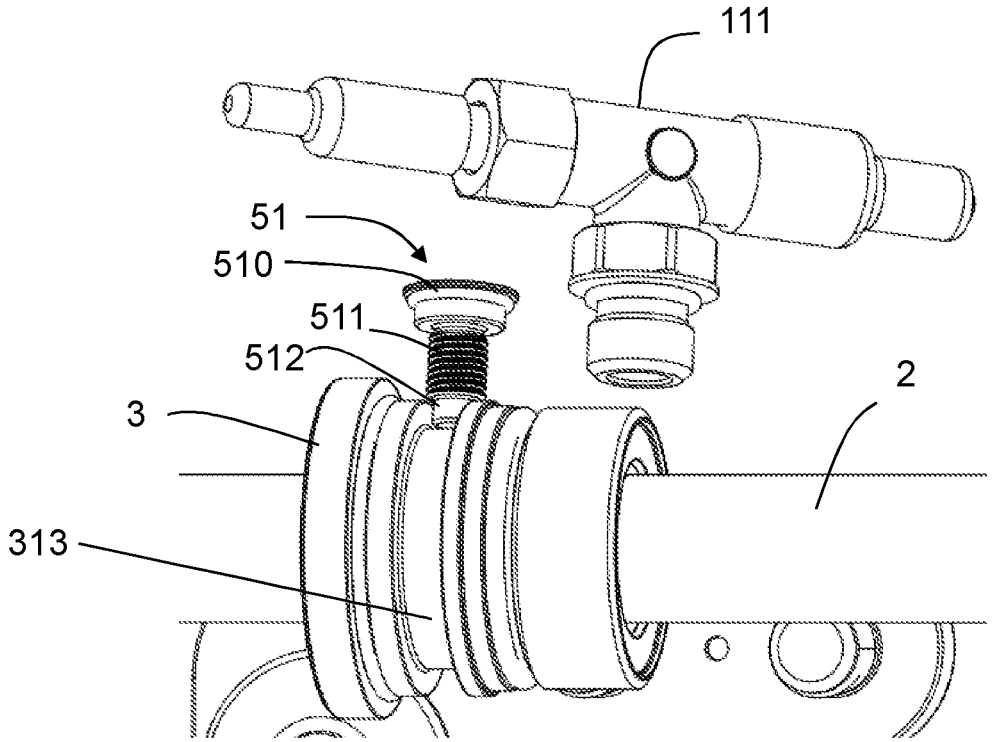
FIG. 8 shows in detail the end cap element of a cylinder according to the prior art.

FIG. 8 shows an example of a sealing head 3 according to the known art. In practice, it is a tubular body acting as a cap screwed on the cylinder. The outer surface of the sealing head 3 has an annular groove 313 positioned at one end of the tubular body, so that when the sealing head 3 is inserted into the cylinder chamber, the groove 313 is aligned with a diametric hole of cylinder 1 for the insertion of a retaining grub-screw 51. The grub screw has a conical head 510, a threaded cylindrical intermediate part 511 and a non-threaded cylindrical end part 512. When the grub screw 51 is screwed into the cylinder hole, the non-threaded end part 512 interferes with the groove 313 of the head 31 and prevents the axial sliding thereof.

Figure 9:
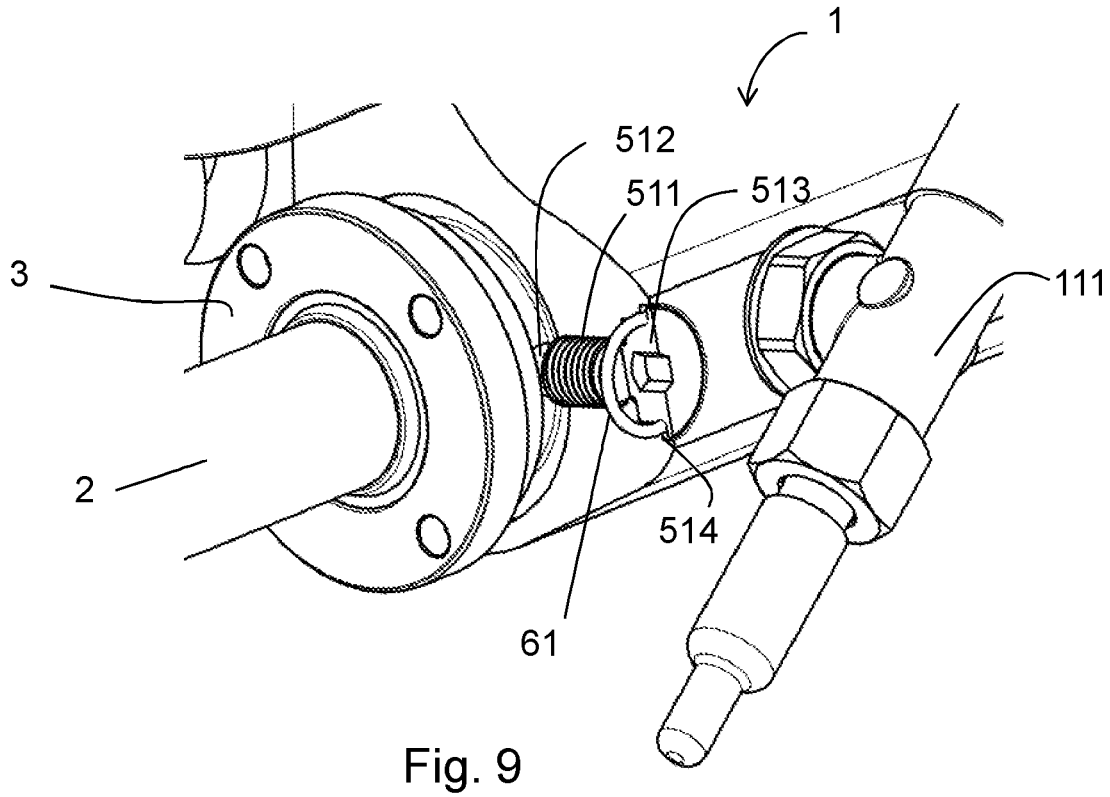
FIG. 9 shows the cap element of the preceding figure with improved fastening grub screw according to an aspect of the present invention.

In order to ensure effective protection against splashing, an aspect of the invention provides that the head 510 of the grub screw 51 is modified. Specifically, a chamfer 513 is emplaced in the conical part, thus creating a seat for housing an O-ring 61 and an abutting counter-step 514 as shown in FIG. 9.

The head 31 can be of any type and shape and is not limited to what is depicted in the figures, for example it can be of a type consisting of two elements, one of which is a sealing element and the other a cap element.

In this case, the sealing element generates the seal, especially on gaskets, by radial action of the cylinder inner walls on the outer walls of the sealing element. On the other hand, the cap element generates a purely axial retaining action of the seal element so as to counteract the axial thrust of the fluid circulating inside the circuit.

The annular groove 313 can be obtained directly on the cap element to prevent it from being axially pulled out accidentally.

Further variations and improvements can be provided without departing from the guiding principle described above and claimed below.

The invention claimed is:

1. A double-acting hydraulic actuating cylinder (1), particularly for hydraulic steering devices of outboard marine engines, comprising:

a rod (2) having the actuating cylinder (1) slidably mounted thereon, said rod being coaxial to said actuating cylinder (1), said rod (2) sealingly protruding from a sealing head of the actuating cylinder (1) and carrying a separating piston that divides the actuating cylinder into two variable-volume chambers, each one of said two chambers having at least one inlet/outlet for a hydraulic control fluid and a sealing head (3) for a relative sliding between the actuating cylinder (1) and the rod (2), said sealing head (3) being integral with the actuating cylinder, wherein said rod (2) is adapted to be non-slidably connected to a bracket (4) to fasten said actuating cylinder (1) to a marine engine (5), so as to allow a rotation of said marine engine (5) along an axis parallel to an axis of the rod (2), wherein the rod (2) has at least one flattened surface (22), and wherein the at least one of the ends (21) of the rod (2) have either a male thread defining a threaded region on an outer side of the rod for coupling with a nut (43), or a female thread defining a threaded axial hole (23) adapted for coupling with a bolt (45), to fasten the bracket (4) to the rod (2) using end elements (42) that are correspondingly perforated.

2. The double-acting hydraulic actuating cylinder (1) according to claim 1, wherein the at least one flattened surface (22) is defined in proximity of at least one of opposite ends (21) of the rod (2).

3. The double-acting hydraulic actuating cylinder (1) according to claim 2, wherein at one or both of the opposite ends (21) of the rod (2) there are two diametrically opposite flattened surfaces (22).

4. The double-acting hydraulic actuating cylinder (1) according to claim 1, wherein the at least one flattened surface (22) is formed on an outer thread in proximity of the at least one of the ends (21) of the rod (2).

5. The double-acting hydraulic actuating cylinder according to claim 4, wherein a length of the male thread and a position of the at least one flattened surface (22) are such that, when the end elements (42) of the bracket (4) are mounted on the rod (2) with the nut tightened, a portion of the thread containing the at least one flattened surface (22) is not, at least partially, engaged by the nut (43).

6. The double-acting hydraulic actuating cylinder (1) according to claim 1, wherein the at least one flattened surface (22) is provided at a distance from the at least one of the ends (21) of the rod (2) such that, when the bracket (4) is mounted on the rod (2), the at least one flattened surface (22) is placed into a thickness of one of the end elements (42) of the bracket (4).

7. The double-acting hydraulic actuating cylinder (1) according to claim 1, wherein at least one of the end elements (42) of the bracket (4) has an annular shoulder (47) adapted to abut the at least one end of the rod (2) so as to ensure a correct positioning of the at least one flattened surface (22) inside the at least one of the end elements (42).

8. The double-acting hydraulic actuating cylinder (1) according to claim 1, wherein the rod (2) has an annular groove (46) for insertion of a sealing ring in a position rearward of the at least one flattened surface (22), the at least one flattened surface and the groove having a longitudinal extension sufficient to be contained in a thickness of one of the end elements (42) of the bracket (4), when the bracket (4) mounted on the rod (2).

9. The double-acting hydraulic actuating cylinder (1) according to claim 1, further comprising a washer (44) between a head of the nut (43) or bolt (45) and one of the end elements (42) of the bracket (4).

10. The double-acting hydraulic actuating cylinder (1) according to claim 9, wherein the washer (44) has radial legs foldable on the head of the nut (43) or bolt (45) and disposed inside a hole (45) formed in the one of the end elements (42) of the bracket (4) to prevent the nut or bolt from being accidentally unscrewed and to guarantee a predetermined tightness level.

11. A combination of a rod (2) of a double-acting cylinder (1) and an end element (42) of a bracket (4) fastening said cylinder to a marine engine (5) for hydraulic steering of said marine engine, wherein the end element (42) has a through hole with an annular shoulder (47) and adapted to receive an abutment of an end of the rod (2) for fastening said abutment end to the end element with a nut (43) or a bolt (45), wherein the rod (2) has at least one flattened surface (22 provided at a distance from the end of the rod, such that, when mounted, said at least one flattened surface is disposed within a thickness of the end element (42), And wherein the end (21) of the rod (2) has either a male thread defining a threaded region on an outer side of the rod for coupling with a nut (43), or a female thread defining a threaded axial hole (23) adapted for coupling with a bolt (45), to fasten the bracket (4) to the rod (2) using an end element (42) that is correspondingly perforated.

* * * * *